US007246756B2

(12) United States Patent
DeWitt

(10) Patent No.: US 7,246,756 B2
(45) Date of Patent: Jul. 24, 2007

(54) TRANSVERSE AXES OSCILLATING WATER SPRINKLER WITH CAM DRIVEN, OSCILLATING NOZZLES

(75) Inventor: Robert E. DeWitt, Oswego, IL (US)

(73) Assignee: Orbit Irrigation Products, Inc., Bountiful, UT (US)

( * ) Notice: Subject to any disclaimer, the term of this patent is extended or adjusted under 35 U.S.C. 154(b) by 222 days.

(21) Appl. No.: 11/007,477

(22) Filed: Dec. 8, 2004

(65) Prior Publication Data

US 2005/0127203 A1 Jun. 16, 2005

Related U.S. Application Data

(60) Provisional application No. 60/528,784, filed on Dec. 11, 2003.

(51) Int. Cl.
*B05B 3/00* (2006.01)
*B05B 1/32* (2006.01)

(52) U.S. Cl. ..... 239/227; 239/243; 239/255; 239/251; 239/97; 239/225.1; 239/236; 239/245; 239/451; 239/455; 239/456

(58) Field of Classification Search ..... 239/97, 239/225.1, 227, 236, 240, 243, 251, 255, 239/263, 390, 451, 452, 455, 456, 457, 458, 239/23; 73/521, 530, 532
See application file for complete search history.

(56) References Cited

U.S. PATENT DOCUMENTS 2,635,007 A * 4/1953 Norman ..... 239/227
4,244,523 A * 1/1981 Looper ..... 239/227
4,261,514 A * 4/1981 Kennard et al. ..... 239/211
4,842,195 A * 6/1989 Koll et al. ..... 239/1
4,860,954 A * 8/1989 Allemann ..... 239/101
4,895,307 A * 1/1990 Swinehart et al. ..... 239/263
5,188,293 A * 2/1993 Burton ..... 239/1
5,482,212 A * 1/1996 Kobryn et al. ..... 239/227
6,209,802 B1 * 4/2001 Koivunen ..... 239/252
6,230,984 B1 * 5/2001 Jager ..... 239/225.1
6,655,830 B1 * 12/2003 Seaman ..... 366/168.2

* cited by examiner

*Primary Examiner*—David A. Scherbel
*Assistant Examiner*—James S. Hogan
(74) *Attorney, Agent, or Firm*—Chapman and Cutler LLP

(57) ABSTRACT

A water sprinkler for irrigating lawn and garden areas has two axes of movement, one transverse to the other. A barrel moves or oscillates on one horizontal axis to direct water spray from nozzles carried on the barrel across the length of the area, and the nozzle outlets also simultaneously move or oscillate on axes transverse to the barrel axis to spray water across the width of the area. As the nozzle outlets move or oscillate in the two transverse directions, the ground area is irrigated uniformly over time by application of water in a criss-cross pattern. The area sprayed can be surprisingly large compared with single-axis oscillators, or the area may be limited to a single row or a narrow rectangular area, by adjustment of the barrel and outlet movement and/or the water pressure.

17 Claims, 3 Drawing Sheets

TRANSVERSE AXES OSCILLATING WATER SPRINKLER WITH CAM DRIVEN, OSCILLATING NOZZLES

Applicant claims the priority of his prior, co-pending Provisional Application, Ser. No. 60/528,784, filed Dec. 11, 2003.

FIELD OF THE INVENTION

The present invention relates to water sprinklers for lawns and gardens.

BACKGROUND OF THE ART

Water sprinklers have conventionally had either a single vertical axis, with a rotating head of various designs, or a single horizontal axis about which a perforated, curved pipe oscillates back and forth. No dual-axis oscillator sprinkler is known, with movement of just one or two nozzle outlets in two directions simultaneously to sprinkle an entire lawn or garden area. U.S. Pat. No. 5,366,157 discloses a vertical axis sprinkler with a variably-elevated nozzle and a variable flow restriction, operating on quite different principles through a very complex structure.

SUMMARY OF THE INVENTION

An object of the present invention is to provide a new type of sprinkler for watering lawns and gardens. The sprinkler should have greater throw of water, more controllability, few moving parts and few piece parts, easy set-up, and non-clogging nozzles, compared with known oscillating sprinklers. Additionally, the sprinkler may be used to spray a single row of foliage, as a row bushes or flowers.

These objects are obtained by providing a sprinkler with, preferably, just one or two nozzles for the flow and direction of pressurized water. The water turns a motor, located either inside a barrel or in a fixed ground base portion, which turns or oscillates the barrel or oscillating arm, just like that of a conventional horizontal-axis oscillating sprinkler. Instead of a row of 18–22 small nozzles on a curved pipe, however, outlet ends of the few nozzles of the invention oscillate both back and forth in a tilting plane that remains parallel to the axis of the barrel and also about axes transverse to such plane and the barrel axis, driven by cams also turned by the motor. The area to be sprinkled is easily established by adjusting the water pressure to set the width of the pattern and by setting radial stops on or to the barrel motion to set the length of the pattern. The sprinkler with two nozzles then provides a criss-cross pattern to the area to be sprinkled, the spray providing over the entire area a substantially uniform volume in each square meter or so.

THE PREFERRED EMBODIMENTS

The invention is depicted in the several drawings in several embodiments and forms.

Figure 1:
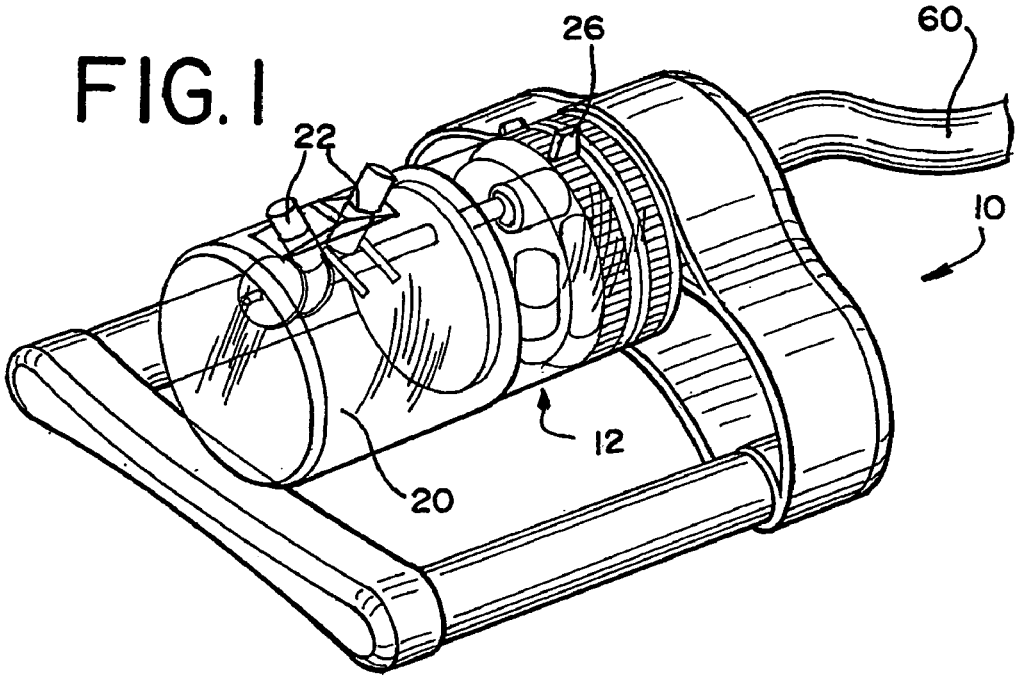
FIG. 1 is a perspective view, partly broken away, to show part of the operating mechanism of one preferred form of the sprinkler of the present invention.
Figure 2:
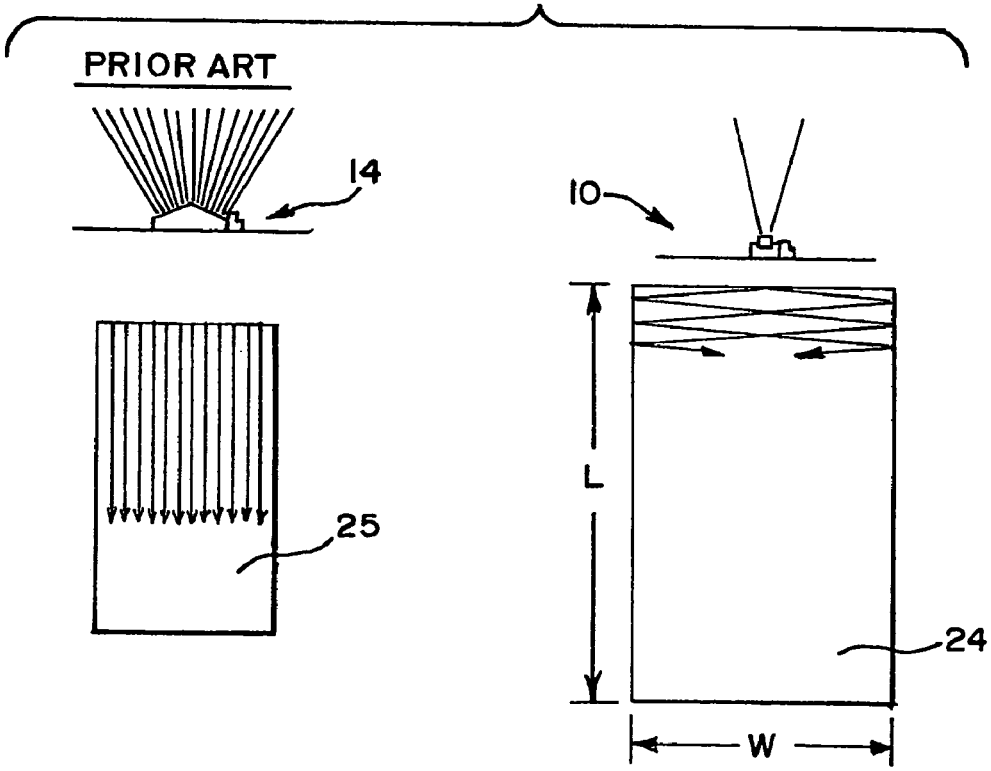
FIG. 2 shows the steps of the operation of a standard oscillator, as prior art, and of the sprinkler of the present invention in an embodiment employing two nozzles.
Figure 7:
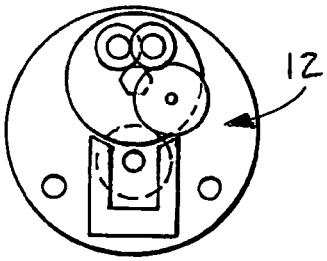
FIG. 7 is an endwise view, on line VII—VII of FIG. 6, of the gear train, cam driver, and barrel oscillation switch of the invention.

The sprinkler 10 in one form of the invention uses, in part, any suitable gear drive and direction reversal mechanism 12 as in FIGS. 1 and 7; several such mechanisms are well known to those skilled in the art in both oscillator sprinklers, as 14 in FIG. 2, and vertical-axis sprinklers (not shown).

A barrel 20 of the sprinkler 10 carries just one or preferably just two nozzles 22 with outlets 23 in much the same manner as known oscillators 14 carry a standard array of 18–22 nozzles on a curved pipe. The two nozzles 22 and their outlets 23 are moved as by oscillation, first, with the sprinkler barrel 20 from 45-degrees on either side of the vertical to spray water over the length L of a lawn or garden 24, as in FIG. 2. This first oscillation can be limited or controlled to a selected lesser arc, if so desired, as a function of a pair of known, adjustably fixed annular stops as 26, either of which may be positioned for stopping the oscillation anywhere within the 90-degree sweep of oscillation about an axis 28** of the barrel.

In accordance with the present invention, the nozzles 22 are carried within or on a surface of the sprinkler barrel 20 such that each of the nozzle outlets 23 extends upwardly, in a neutral or center position of the barrel and control mechanism, and at an angle of about 15 degrees to one side of the vertical, in a plane including the barrel axis 28, in a central, at rest position.

Figure 8:
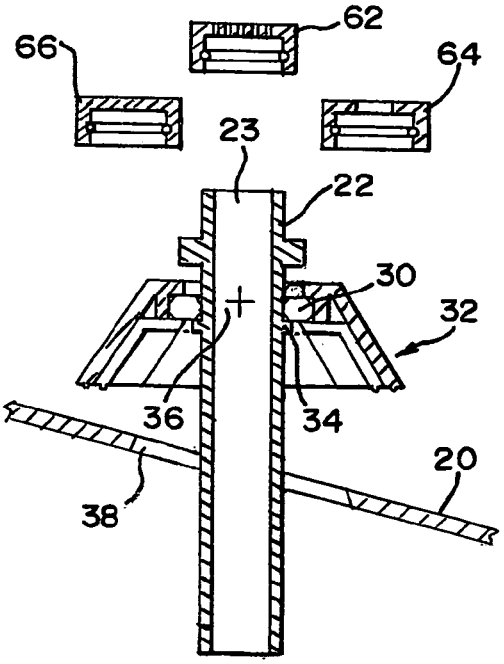
FIG. 8 shows details of one form of the nozzle construction of the present invention, in vertical cross-section, with alternative outlet caps for varied sprinkling applications.

A holding force for setting each of the nozzles 22 at the 15-degree angle from the vertical is provided by an O-ring 30 situated on and around a circumferential surface of the nozzle and by a mounting structure 32 fixed on the exterior of the sprinkler barrel 20, as shown in FIG. 8. Each nozzle 22 is prevented from being expelled from structure 32 under the force of the internal water pressure by a first circumferentially extending portion 34 of the nozzle and by the inwardly extending portion of the O-ring 30, once the nozzle 22 and O-ring 30 are assembled. The nozzles then can pivot at the O-rings 30 on axes 36 that are normal to the axis of the barrel 20 and extend in one or more planes parallel to and spaced above the barrel axis 28 in the rest position of the assembly.

Each of the nozzles 22 extends downwardly through an elongated gate 38, the gate being located some distance directly inwardly and/or outwardly from the O-ring. The gate 38 has sides extending parallel to the axis 28 of the sprinkler barrel 20, such that the pivotal motion of the nozzles 22 in the sideward direction, W in FIG. 2, is limited, at least in this preferred embodiment, to a plane that includes the longitudinal axis 28 of the sprinkler barrel 20. Other, shorter pivot axes may be devised by those of skill in the art.

The pair of nozzles 22 and their outlets 23 are given an oscillating motion in the second direction, W in FIG. 2, by a pair of cams 40 carried on a common shaft 42 that is driven by the gear drive for the movement of the barrel 20. The cams 40 bear upon circumferential surfaces of the nozzles at positions inwardly of the elongated gates 38. The cams 40 as they rotate with shaft 42 push the nozzles 22 in either direction away from their rest positions. The nozzles are returned to their rest positions by either a parallel, second cam surface shown in FIG. 1, or, in a single-surface cam form shown in FIGS. 5A and 5B, by both the centering force exerted by the O-rings 30 and by water pressure acting to expel the nozzles 22 from the barrel 20. The second, parallel cam surface can be provided spaced from the one shown for positive control of the nozzle positions even under low water pressure or aged O-ring conditions.

Adjustable, replaceable, and closable nozzles or nozzle tips can be used in place of the straight-through nozzles 22 and plain outlets 23 as shown. These tips may provide for misting sprays as at 62, finer jets as at 64 for yet longer ranges, closing of one nozzle of a pair or more as at 66, and the like, as may be desired for particular applications. Such adjustable, replaceable, and closeable tips are well known in the irrigation arts and can add adaptability to the sprinkler of the present invention.

Figure 4:
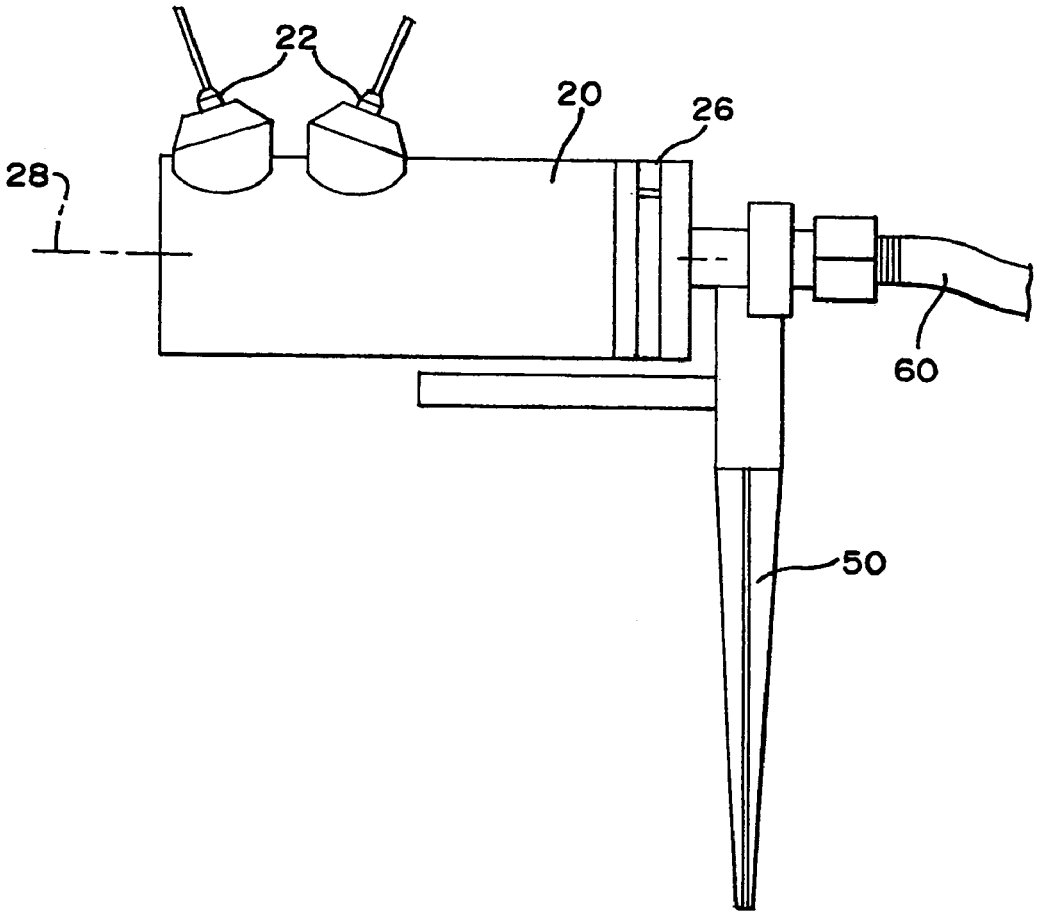
FIG. 4 shows a second embodiment of the sprinkler of the present invention, mounted on a stake insertable into the ground.

Other designs may be developed using these principles, including for instance a form carried on a stake 50 inserted into the ground for use, as in FIG. 4. Designs may have one, two, three, or four nozzles 22. A single-nozzle form, for instance, can have a ground coverage pattern of approximately twice the area that may be covered by conventional oscillators, although more time would be required to cover the larger area, of course.

Figure 5A:
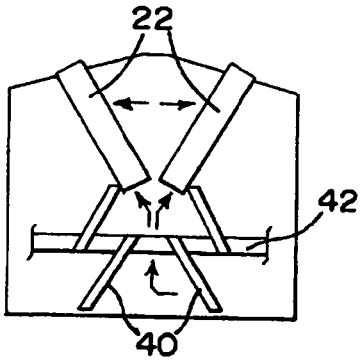
FIGS. 5A and 5B depict in schematic form two positions of the rotating cams that cause the sideward oscillation of the nozzles of the present invention.
Figure 5B:
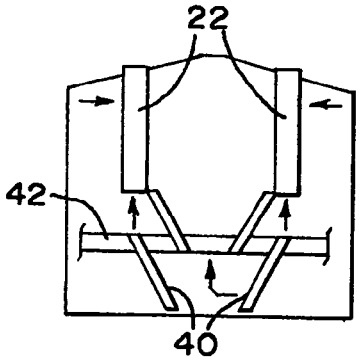
Figure 6:
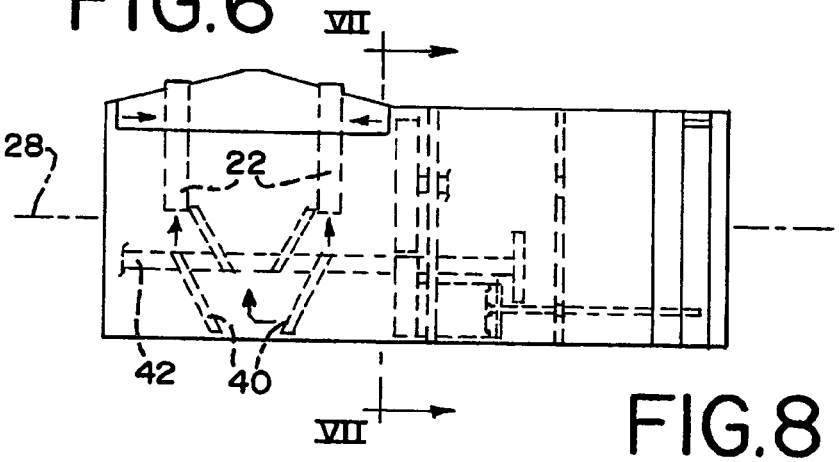
FIG. 6 is a side view of one form of the nozzle and barrel drive assemblies.

In operation, water flows at a selected pressure from a garden hose or similar source 60, through the impeller and barrel 20 and the drive mechanism, and out through the nozzles 22 and their outlets 23. The impeller rotates cam shaft 42 and cams 40, which cause nozzles 22 to oscillate sidewardly from their 15-degree rest positions between vertical and about 30-degrees from vertical in the W direction of FIG. 2, as shown in FIGS. 5A and B. Together, the nozzles 22 and outlets 23 cover a 60-degree sideward sweep, and in so doing they duplicate each of the water jet trajectories of the standard 18–22 fixed nozzles of known sprinkler 14, but with the important advantage of having a much larger water flow and range. Over sufficient time, the entire area is substantially uniformly watered so there are no dry or drenched spots in the coverage area. The distance of the sideward spray is preferably determined by the pressure of water provided to the sprinkler in this embodiment, but mechanical means for varying the sideward throw of the sprinkler 20 are readily available with some increase in complexity.

The nozzles 22 oscillate simultaneously with movement of the barrel 20 to provide water coverage also in the L direction of FIG. 2. The length L can be varied by adjusting the stops 26, 26, setting the end-points of the pattern, as is known with conventional oscillating sprinklers.

Figure 3:
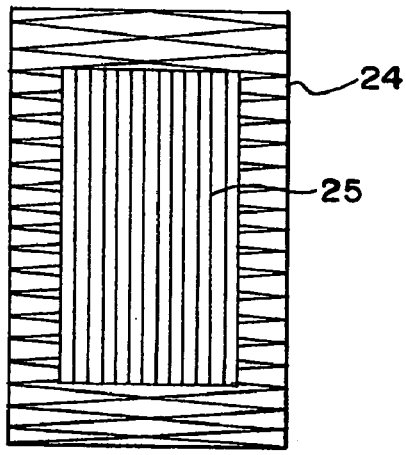
FIG. 3 compares the pattern density, size, and coverage of the prior art sprinkler and the sprinkler of the present invention.

The nozzles 22 oscillate sidewardly in direction W at a higher frequency than the movement or oscillations of the barrel 20 in direction L, thus providing a dense, criss-cross water coverage on the lawn, garden, or other space, as shown in FIG. 2. Because the two oscillations are coordinated mechanically, all points of the entire area within the spray pattern are substantially uniformly irrigated. The ground coverage 62 effected by the sprinkler 10 of the present invention is surprisingly much larger than that, at 64, provided by conventional, known sprinklers 14, for the same water pressure, as shown in FIG. 3. Limiting the length of the area sprinkled can be useful if a long but thin area is to be irrigated.

Many variations may be made in the invention as shown and its manner of use without departing from the principles of the invention as pictured and described herein and claimed as my invention. Minor variations will not avoid the use of the invention.

I claim as my invention:

1. A water sprinkler having at least one spray nozzle outlet, the nozzle outlet being moved about each of two axes, a first axis being horizontal and a second axis tilting about a line that is generally transverse to the first axis, for irrigating with airborne spray a ground area in a pattern having a width and a length, the sprinkler being supplied with water under pressure and comprising:

a first means for moving the nozzle outlet about a first axis which extends generally horizontally;

a second means for moving the nozzle outlet about a second axis that is generally transverse to the first axis; and flow channel means for passing water through the sprinkler and to the nozzle outlet.

2. A water sprinkler as defined in claim 1, wherein the first means comprises a barrel with a circumferential periphery, the barrel moving about the first axis and carrying the spray nozzle outlet on or adjacent said periphery thereof.

3. A water sprinkler as defined in claim 1, wherein the second means comprises a rotating cam surface causing the nozzle outlet to move about said second axis and generally in a plane including the first axis.

4. A water sprinkler as defined in claim 1, wherein the movements caused by the first and second means are synchronized with each other so that substantially all portions of the ground area receive an equal volume of water over time.

5. A water sprinkler as defined in claim 1, wherein the sprinkler has at least two spray nozzle outlets, all of said outlets being driven by the first and second means to sprinkle water in substantially uniform volumes over sufficient time in all portions of said ground area.

6. A water sprinkler as defined in claim 1, wherein the pressure of water provided to the sprinkler determines the width of the pattern sprayed.

7. A water sprinkler as defined in claim 1, further comprising mechanical stop means set on one of the first and second means for controlling at least one of the width and the length of the pattern sprayed.

8. A water sprinkler as defined in claim 1, wherein at least one of said outlets is selectively closed as with a cap, to increase the volume and pressure of water flow through the other outlet or outlets.

9. A water sprinkler as defined in claim 1, wherein at least one of the nozzle outlets is selectively fitted with a modified outlet of relatively small cross-section, to increase the distance that water is sprayed therefrom.

10. A water sprinkler as defined in claim 1, wherein at least one of the nozzle outlets is selectively fitted with a misting outlet means for dispersing water in a directed mist rather than a stream or jet.

11. A water sprinkler as defined in claim 1, wherein the pressure of water to the sprinkler determines one of the width and the length of the pattern sprayed.

12. A water sprinkler as defined in claim 1, wherein the first means is temporarily disabled from oscillating, so that the second means will oscillate to irrigate a ground area having a length and negligible width so as to direct the spray over a single row of foliage.

13. A water sprinkler as defined in claim 1, wherein the nozzle is selectively fitted with a misting outlet means for dispersing the water in a directed mist rather than a stream or jet.

14. A water sprinkler having at least one spray nozzle, the sprinkler having two generally transverse axes of movement of its spray nozzle in operation, the sprinkler comprising:

a main body connected to a source of pressurized water for spraying said water onto a lawn or garden area from a fixed position in respect of said area;

a barrel carried on the main body for movement about a first, generally horizontal axis passing through the barrel, and the barrel having a peripheral exterior surface;

first drive means operating between the main body and the barrel for causing controlled movement of the surface of the barrel over at least a selected arc about the first axis with respect to the main body;

second drive means in at least one of the main body and the barrel for rotating a shaft extending parallel to the first axis, the shaft carrying at least one camming means;

at least one spray nozzle, each said nozzle having a water outlet and being carried near said peripheral surface of the barrel for movement of its outlet in an arc extending in a plane generally parallel to the first axis and about a second axis extending spaced from and transverse to the first axis, under at least partial control of the camming means, whereby water from the source passes through the main body, the barrel movement means, and said at least one spray nozzle and its outlet and said water is directed by said at least one nozzle outlet over a selected path substantially covering over time a desired area of the lawn or garden, as the barrel moves over the selected arc about the first horizontal axis and each nozzle outlet at the same time moves transverse to that arc, so as to cover the selected area in a criss-crossing pattern.

15. A water sprinkler as defined in claim 14, wherein the sprinkler has at least two nozzles carried on the barrel, at least two outlets, and at least two camming means carried on the shaft.

16. A water sprinkler as defined in claim 15, wherein one of said at least two outlets is selectively closed by an impervious cap, to increase the volume and pressure of water flow through the other nozzle.

17. A water sprinkler as defined in claim 14, wherein the nozzle outlet is selectively fitted with a modified outlet of reduced cross-section, to increase the distance that water is sprayed therefrom.

* * * * *